United States Patent [19]

Ranney et al.

[11] 4,099,178

[45] Jul. 4, 1978

[54] TEST MEANS FOR LIGHT RESPONSIVE SMOKE DETECTOR

[75] Inventors: Richard D. Ranney, Hermosa Beach; Gustav Hubert, San Gabriel, both of Calif.

[73] Assignee: Emdeko International, Inc., Salt Lake City, Utah

[21] Appl. No.: 785,432

[22] Filed: Apr. 7, 1977

[51] Int. Cl.[2] ..... G08B 29/00

[52] U.S. Cl. ..... 340/515; 250/574; 340/630

[58] Field of Search ..... 340/214, 410, 237 S; 250/573, 574, 575; 356/103

[56] References Cited

U.S. PATENT DOCUMENTS

| | | | |
|---|---|---|---|
| 2,437,071 | 3/1948 | Cahusal et al. | 340/237 S |
| 2,763,853 | 9/1956 | Grant, Jr. | 340/237 S |
| 2,783,390 | 2/1957 | Mendenhall, Jr. | 250/574 X |
| 3,028,490 | 4/1962 | Guilleux | 340/237 S X |
| 3,240,109 | 3/1966 | Grant, Jr. | 340/237 S X |
| 3,868,184 | 2/1975 | Marsocci | 356/103 |
| 4,021,792 | 5/1977 | Ludt et al. | 340/237 S |
| 4,053,785 | 10/1977 | Lee et al. | 250/574 |

*Primary Examiner*—John W. Caldwell, Sr.
*Assistant Examiner*—Daniel Myer
*Attorney, Agent, or Firm*—Poms, Smith, Lande & Glenny

[57] ABSTRACT

A test means for a smoke detector of light responsive type which includes a light source, a smoke chamber, a light responsive device sensitive to a light beam reflected from a preselected density of smoke in the smoke chamber for actuating an alarm signal, the test means including the same light source and light responsive device and having a separate test light path other than through said smoke chamber with light modifying means in the test light path to simulate a preselected smoke density. The test means includes a normally closed gate for said test light path, the gate being manually opened to transmit light along said test path to the light responsive device to cause actuation of the alarm in the absence of smoke in the smoke chamber.

11 Claims, 6 Drawing Figures

TEST MEANS FOR LIGHT RESPONSIVE SMOKE DETECTOR

BACKGROUND OF INVENTION

There has been considerable development in the construction and operation of smoke detectors of various types for emitting a warning or an alarm signal when smoke reaches a density indicative of a fire. One of the types of smoke detector alarms includes the use of light responsive means, such as photocells, for receiving a light beam emanating from a light source in the detector housing and reflected off smoke particles in a smoke chamber to the photocell. Since the purpose of a smoke detector is to be immediately activated in the event of a fire at any time of the day or night, it is necessary that such a smoke detector be readily tested for its operability and warning function at suitable regular intervals. Inoperability of smoke detector at the time of a fire destroys the entire purpose of the smoke detector. Therefore, it is imperative that a test means be provided for smoke detectors to rapidly, conveniently and easily test operability of the detector.

In smoke detectors which respond to a reflected light beam from smoke particles in the smoke chamber, testing could be accomplished by creating a supply of smoke beneath the detector device until the smoke entered the smoke chamber and the preselected smoke density was reached in the chamber to activate the alarm. If the alarm was not activated, it would be presumed that the alarm device was inoperable. However, inoperability of the smoke detector might be caused by several factors, including density of the smoke in the chamber, intensity of the light beam source, responsiveness of the photocell, and the electrical circuitry which was connected to the photocell and electrically actuated an alarm signal.

Prior proposed test means for smoke detectors of light responsive type have included the use of sevral photocells, a supervisory control circuit to activate the alarm upon failure of electrical components in the smoke detector circuit, and the use of a test probe means inserted in the smoke chamber, the test probe means having a reflective equivalence with respect to the light source and photocell of predetermined concentrations of smoke in the smoke chamber for specified depths of insertion of the probe into the smoke chamber, see U.S. Pat. No. 3,585,621. Such prior proposed testing means known to us did not provide a means for quickly and rapidly determining whether the smoke device was operable by making such test without entering the smoke chamber and by manually moving an external arm a preselected distance.

SUMMARY OF INVENTION

The present invention relates to a test means for a smoke detector of the type which responds to a light beam wherein the detector is tested in the absence of smoke and may be quickly and immediately tested it any time without any test preparation.

The invention more particularly relates to a test means for a light responsive means smoke detector device wherein a separate test light path is provided adjacent to the normal smoke detecting light path, the test path being arranged to not pass through the smoke chamber. Light modifying means are positioned in the test light path so that the modified light transmitted to the light responsive cell will cause the light cell to respond as if said preselected smoke density was in the smoke chamber for actuating the alarm. Light along the test light path is selectively transmitted to the light cell; that is, normally the test light path is closed by a gate means. Associated with the gate means is an adjustment means for regulating the amount of light to be transmitted to the light cell for its actuation.

The main object of the present invention is to provide a novel test means for a light responsive smoke detector device wherein a test of operability of the device may be quickly, effectively, and readily made under simulated conditions and in the absence of smoke.

An object of the present invention is to provide a test means for a smoke detector device which is readily calibrated to respond to a simulated preselected smoke density.

Another object of the present invention is to provide a test means for a smoke detector device in which the test means is normally inoperative and wherein the test means may be manually actuated with an immediate, instantaneous response as to whether the smoke detector device is operable or not operable.

Another object of the present invention is to provide a test means for a smoke detector device wherein the test means includes a separate test light path provided with means making said test light path normally inoperative and which may be made operative by manipulation of means externally located with respect to the smoke detector.

A still further object of the present invention is to provide a test means for a smoke detector device in which the test means utilizes a light modifying means which simulates the preselected density of smoke in the smoke chamber, the light modifying means being interposed in the test light path.

Various other objects and advantages of the present invention will be readily apparent from the following description of the drawings in which an exemplary embodiment of this invention is shown.

IN THE DRAWINGS

Figure 2:
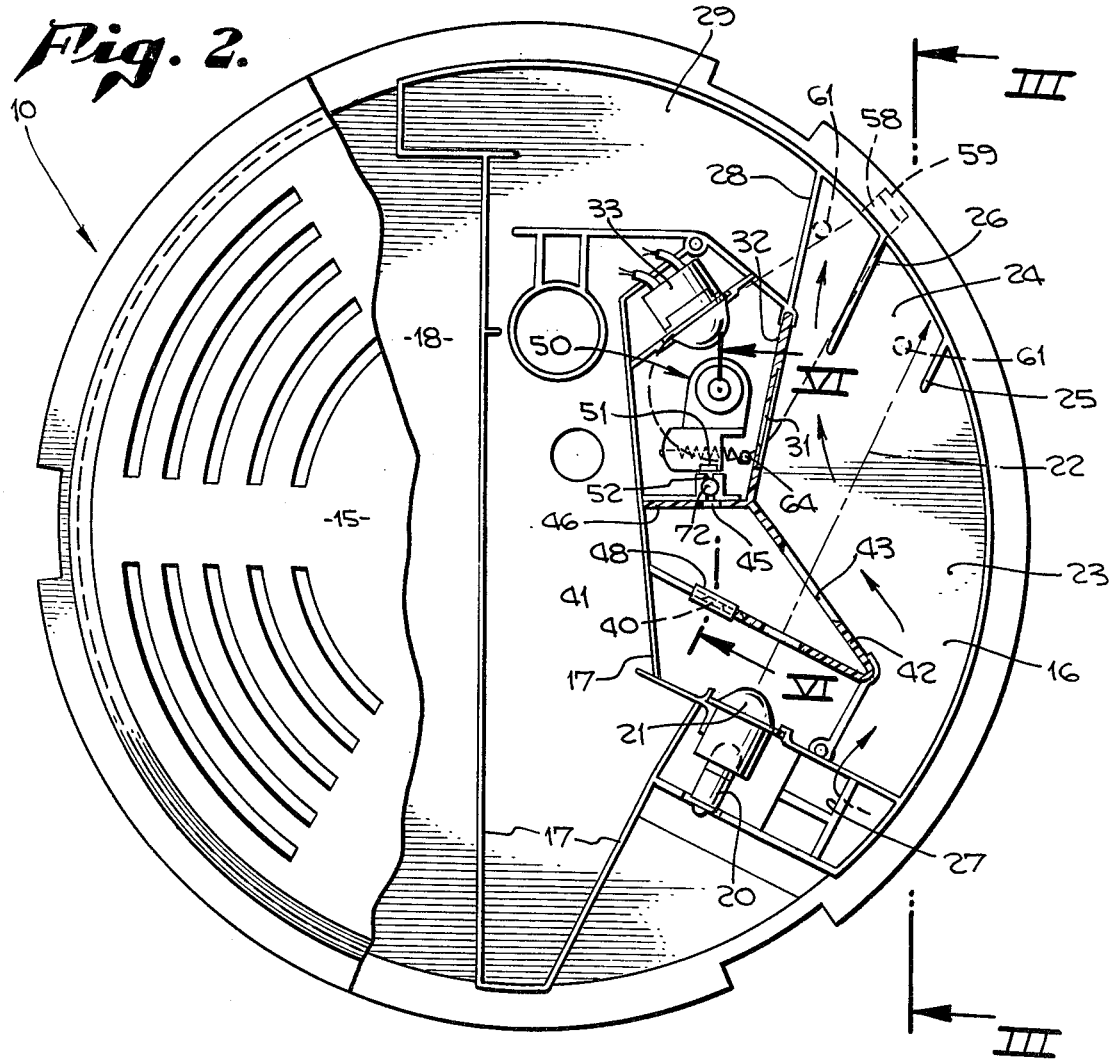
FIG. 2 is a plan view of the device shown in FIG. 1, a portion of the cover of said device being removed to better illustrate this invention.
Figure 1:
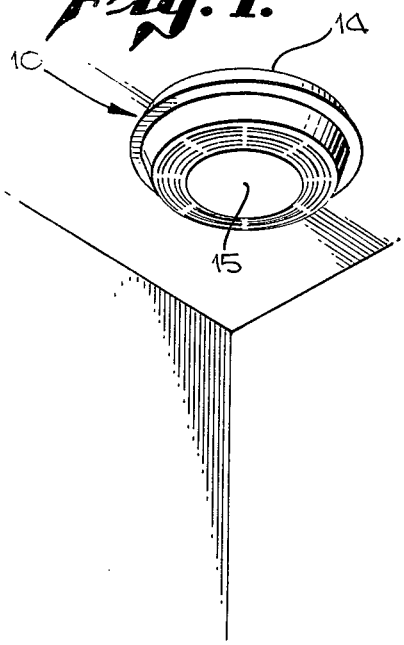
FIG. 1 is a fragmentary schematic perspective view of a corner of a room in which a smoke detector device embodying this invention is mounted on the ceiling thereof.
Figure 6:
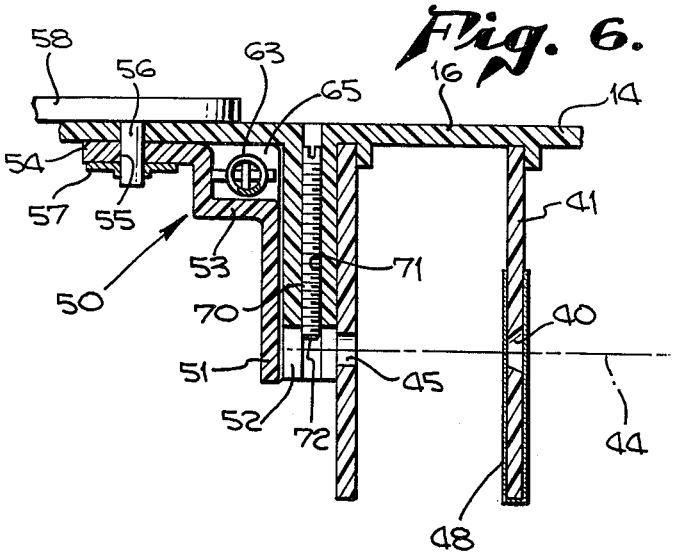
FIG. 6 is a fragmentary enlarged sectional view taken in the plane indicated by line VI — VI of FIG. 2.

A smoke detector device generally indicated at 10, FIG. 1, is shown installed on the ceiling of a room. Smoke detector device 10 includes a known construction and a mode of operation for detecting smoke, this invention being directed particularly to test means for said device. For clarity, only that portion of smoke detector device 10 which relates to an understanding of the present invention will be described.

Generally speaking, smoke detector device 10 includes a housing 12 comprising a bottom housing portion 14 and a top cover 15. Bottom housing portion 14 includes a bottom wall 16 of circular form having a plurality of upstanding walls 17 arranged in a particular manner to facilitate the containment of various pieces of electronic circuitry located in space 18, not shown, and serving to provide an alarm system. The smoke detector device 10 is photoresponsive to the presence of smoke and as such includes a light source 20, a lens means 21 for said light source to direct a light beam 22 into a smoke chamber 23. Light beam 22 is directed into a light trap 24 formed by spaced upstanding walls 25 and 26. Smoke enters chamber 23 through an inlet port 27 and follows a path generally indicated by arrows to the smoke chamber 23 by flowing behind wall 26 and over wall 28 into an exit chamber 29 from which the smoke escapes through an exit port in the cover above exit chamber 29. Flow of smoke in the smoke chamber 23 passes across light beam 22. Light beam 22 is reflected by the smoke through a light port 31 in partition 32 for impingement upon a light responsive photocell 33. Photocell 33 is connected by leads to the electronic circuitry in the space 18 and at a selected light response related to a preselected density of smoke in the smoke chamber the light responsive photocell 33 will cause actuation of an alarm means not shown. The general description of the structure and mode of operation of smoke device 10 is known and is presently manufactured. The structure and mode of operation generally described above is not part of this invention.

This invention relates to a test means whereby the preselected density of smoke in the smoke chamber 23 is simulated so that the alarm device may be quickly tested for operability in the absence of smoke in smoke chamber 23. The test means of this invention includes providing a test light path from light source 20 to photocell 33 and the interpositioning in said light path of a light modifying means which simulates the preselected smoke density which would cause actuation of the alarm device if smoke were in smoke chamber 23. The test means is normally inoperative and may be made operable by mechanical means hereinafter described in detail.

The test means of this invention provides for a first light aperture 40 in a first partition wall 41 which is spaced from light source 20 and lens means 21, partition 41 being normal to the light beam emanating from light source 20. A second partition 42 is disposed at acute angle relationship with partition 41 and includes an enlarged second light port 43 through which the light beam 22 passes and is transmitted into the smoke chamber 23. The test light path indicated at 44, FIG. 5, then passes through a second light aperture 45 to photocell 33. Second light aperture 45 is provided in a partition 46 which is joined with partition 42 and with partition 32 which includes light port 31. Test light path 44 is thus a straight light path from the light source 20 to photocell 33.

Light for the test light path 44 is obtained from the light source 20 and particularly from the fringe or stray light which emanates from lens 21 adjacent its periphery. The intensity of such stray light and its concentration is not of the same value as light beam 22. The intensity of the light beam 44 is measured and is modified by a light diffusing sheet or sheets 48 applied to partition 41 to cover light aperture 40. In this illustration, the light diffusing sheet is applied to both sides of aperture 40 and serves to reduce the intensity of light exiting from aperture 40 and transmitted through aperture 45 to a light value which is the equivalent of the value of the reflected light from the preselected smoke density of smoke in chamber 23. An example of light modifying material usable at aperture 40 is that of a white translucent mylar film or a scotch tape.

Means for selectively transmitting light along the test light path 44 includes a gate 50 having an upstanding gate portion 51 which normally covers a vertically extending slot 52 which is aligned with and positioned behind the second light aperture 45. In the test light path 44, gate portion 51 includes a right angle offset portion 53 and a base portion 54 having a hole 55 for reception of a pin 56 for pivotal mounting of the gate 50 on the bottom wall 16 of the housing portion. A disc retainer 57 holds said pin and base portion 54 in assembly. Pin 56 is connected with an arm 58 which extends radially and parallel to the bottom wall 16 and terminates in an upstanding tap 59 which lies adjacent the outer circumferential surface 60 of the bottom housing 15. Bottom wall 16 is provided with suitably spaced downwardly directed stop pins 61 which limit the angular movement of the arm 58.

Figure 4:
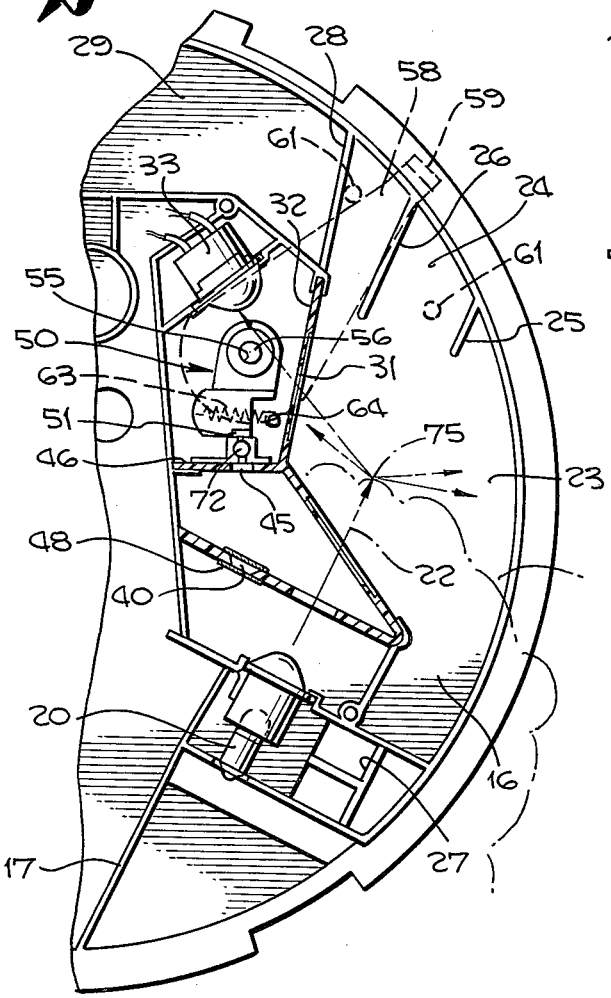
FIG. 4 is a fragmentary plan view of the device showing the smoke detector light path, the view being taken in a horizontal plane indicated by line IV — IV of FIG. 3.
Figure 5:
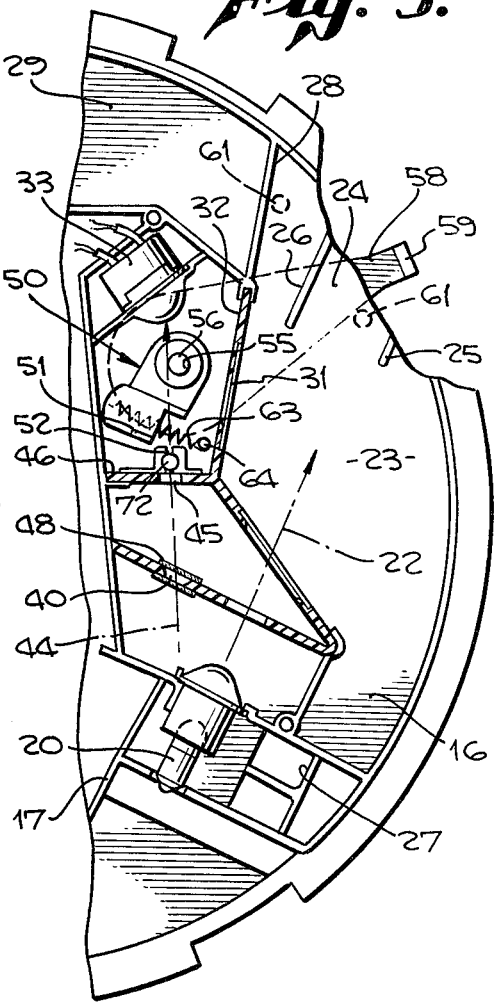
FIG. 5 is a fragmentary view taken from the same plane as FIG. 4 and showing operation of the test light path.
Figure 3:
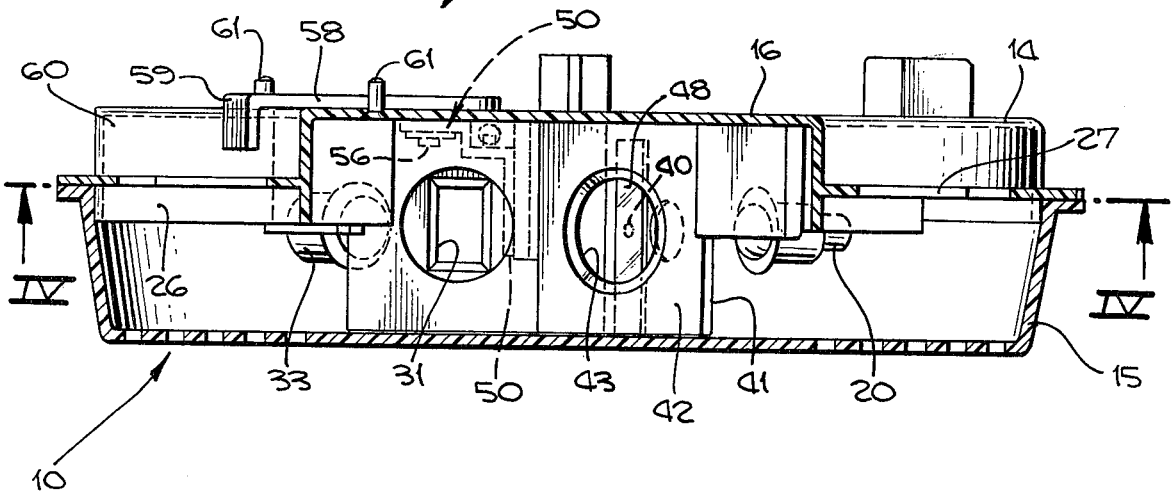
FIG. 3 is a vertical sectional view taken in the plane indicated by line III — III of FIG. 2.

Arm 58 and gate 50 are normally biased into closed position by a coil spring 63 connected at one end to a pin 64 on the bottom wall 16 and connected at its other end to portion 65 at one end of the offset 53 of the gate 50, said spring 63 being housed in the offset portion 53. As best seen in FIGS. 4 and 5, spring 65 closes gate 50 and positions gate portion 51 over slot 52 to obstruct the path of light 44 and prevents such light from reaching the photocell 33.

When gate 50 is in open position, light transmitted through light aperture 45 and light slot 52 impinges upon photocell 33. The amount of light which exits through slot 52 may be adjusted by an elongated set screw 70 threaded in threaded bore 71 and readily available for adjustment in the opening of bore 71 in bottom wall 16. When set screw 70 is turned so that its end face 72 is interposed in the light exiting from light aperture 45, it will be readily apparent that the amount of light transmitted directly to the photocell 33 will be diminished.

Adjustment set screw 70 facilitates calibration of the test means. Light modifying means 40 is preselected to transmit light from light source 20 of the same intensity as the light beam reflected from smoke particles and which impinges upon the photocell 33. Fine adjustment of these values are readily made by the set screw 70 since moving the set screw to position its end face 72 further into the test light path exiting from light aperture 45 will tend to reduce the amount of light reducing the photocell 33. Thus, the light traveling along the test path 44 may be modified as to amount and intensity and may be readily adjusted to correspond with the desired amount and intensity of the light beam reflected from the smoke chamber in which a predetermined smoke density is provided for indicating and actuating the alarm.

In normal operation, it will be understood that the smoke detector device 10 may be mounted on a ceiling normally out of unassisted reach and that the light source 20 continuously emits a light beam which is visible to a person standing beneath the smoke detector 10. In some alarms in the event of failure of the light source 20, a signal is automatically emitted to indicate lack of a light source. Such an arrangement is not part of this invention. Light beam 22 is continuously emitted from light source 20 and in the event smoke in the room reaches the density to actuate the alarm, such smoke will be inducted into the smoke chamber 23, light beam 22 reflected thereoff, and the reflected beam will impinge upon the photocell 33 and actuate the smoke detector alarm.

In the absence of smoke and when it is desired to test the smoke detector device 10, tab 59 may be pushed by a finger to rotate arm 58 and to open gate 50 to permit light from light source 20 traveling along the test light path 44 to impinge upon photocell 33. Since the characteristics of the light impinging upon the photocell 33 have been arranged to have the same characteristics as light reflected from smoke particles in the smoke chamber, the alarm will be activated if the smoke detector device is in operable condition.

In the event the device is not operable, and since the standard smoke density was simulated in the test light path, it will be apparent that the source of trouble may lie in a diminished light intensity at the light source, a changed responsiveness in the light photocell, or a defect within the circuitry connected to the photocell. Operable or inoperable condition of the smoke detector device is immediately determined by pressing the tab externally of the device on arm 58. The detector device should respond immediately; upon such response, the tab is released the gate 50 closes the test light path and the smoke detector device remains in its operable condition.

It should be noted that the constructions of the several partitions, the interior of the smoke chamber, and other interior surfaces of the smoke detector device are provided with black coatings to reduce and virtually eliminate reflected light within the device. The principal light path 22 and the test light path 44 are separate, independent light paths. The black coating on the several partitions assists maintaining such separability so that neither light path is affected by light reflected from the other light path. Light for both light paths emanates from the same light source, although the light traveling the main light path 22 is focused on a focal plane at 75 to obtain the most effective reflection of light from smoke particles to the photocell 33. Light from light source 20 passing along the test light path 44 is essentially stray light beams emanating from the peripheral margins of the lens 21 and is readily available without modifying the characteristics of light source 20 and lens 21.

It will be readily understood by those skilled in the art that various modifications and changes may be made in the test means of this invention and in the configuration of the test light path, light modifying means therefor, and the gate means therefor. All such changes and modifications coming within the scope of the appended claims are embraced thereby.

We claim:

1. Test means for a smoke detector device having a light source, a light responsive cell, and a smoke chamber therebetween, light from said light source being directed along a path to said smoke chamber and reflected from smoke in said chamber to said light responsive cell for activating an alarm at a selected smoke density, comprising:

means for selectively transmitting along a test light path different from said first path part of said light from said light source to said light responsive cell;

and means positioned in said test light path to modify the light being transmitted so that light reaching said light cell will cause said light cell to respond as if said preselected smoke density was in said chamber for actuating said alarm.

2. Test means as stated in claim 1 wherein said selective transmitting means includes a gate member removably positioned across said test light path.

3. A test means as stated in claim 2 wherein said gate member includes an external gate arm connected thereto.

4. A test means as claimed in claim 2 wherein said gate member is pivotally mounted and spring biased into normally closed position.

5. A test means as claimed in claim 2 wherein said light modifying means includes a light port and a light diffusing means covering said port, said light diffusing means having characteristics simulating a selected smoke density in said smoke chamber.

6. A test means as claimed in claim 1 wherein said selective light transmitting means includes a light adjustment means in said test light path at said gate member.

7. In a smoke detector device having a smoke chamber, a light source directing a light beam into said chamber for reflection from smoke therein to a light responsive cell for actuating an alarm the combination of:

means defining a light path from said light source to said light cell and including a first partition having a light port, a second partition arranged at an acute angle to said first partition and having an enlarged light port, and a third partition having a light port to transmit light reflected from particles of smoke in said smoke chamber to said light cell, said partitions and respective light ports defining a first light path;

means defining a second test light path between said light source and said light responsive cell and including a light aperture in said first partition spaced from said first light port, a fourth partition having a light aperture for transmitting a light beam received from said light source through said first light aperture to said light cell;

light modifying means in said test light path whereby light received by said cell from said test light path simulates light reflected from a selected density of smoke in said chamber and received by said light cell;

and means rendering said test light path inoperative.

8. In a smoke detector device as claimed in claim 7 wherein said light modifying means includes a sheet of light translucent material of selected light transmission characteristics covering said light aperture in said first partition wall.

9. In a device as claimed in claim 7 including means for adjusting the amount of light transmitted through said second light aperture in said fourth partition.

10. In a device as claimed in claim 7 wherein said means for rendering said test light path inoperative includes a gate normally closing said light aperture in said fourth partition.

11. A device as claimed in claim 10 wherein said gate includes an actuating arm extending externally of said device.

* * * * *

UNITED STATES PATENT AND TRADEMARK OFFICE

CERTIFICATE OF CORRECTION

PATENT NO. : 4,099,178

DATED : July 4, 1978

INVENTOR(S) : Richard D. Ranney and Gustav Hubert

It is certified that error appears in the above-identified patent and that said Letters Patent are hereby corrected as shown below:

Column 1, line 39 change "sevral" to --several--.
Column 4, line 53 change "reducing" to --reaching--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*